US006571842B2

(12) United States Patent
Paik

(10) Patent No.: US 6,571,842 B2
(45) Date of Patent: Jun. 3, 2003

(54) FOLDABLE WALLET MADE OF TEXTILE FABRICS

(75) Inventor: Searn Y. Paik, Seoul (KR)

(73) Assignee: Pan Nations Development Enterprises, Inc., Kyonggi-do (KR)

( * ) Notice: Subject to any disclaimer, the term of this patent is extended or adjusted under 35 U.S.C. 154(b) by 0 days.

(21) Appl. No.: 09/808,044

(22) Filed: Mar. 15, 2001

(65) Prior Publication Data

US 2002/0129882 A1 Sep. 19, 2002

(51) Int. Cl.[7] ..... A45C 1/06
(52) U.S. Cl. ..... 150/146; 150/142
(58) Field of Search ..... 150/146, 142, 150/131, 132, 141, 144, 129

(56) References Cited

U.S. PATENT DOCUMENTS 1,737,972 A * 12/1929 L'Enfant ..... 150/135
1,821,379 A * 9/1931 Epstein ..... 150/132
2,403,507 A * 7/1946 Davio ..... 150/144
2,535,387 A * 12/1950 Broughton ..... 150/138
2,781,810 A * 2/1957 Landdeck ..... 150/142
4,671,332 A 6/1987 McPhee
5,230,627 A * 7/1993 Todd ..... 150/135
5,257,656 A 11/1993 McLeroy
5,544,750 A * 8/1996 Randall ..... 150/131
6,050,311 A 4/2000 Obenski

* cited by examiner

*Primary Examiner*—Lee Young
*Assistant Examiner*—Lien Ngo
(74) *Attorney, Agent, or Firm*—Wenderoth, Lind & Ponack, L.L.P.

(57) ABSTRACT

The present invention relates to a foldable wallet made of textile fabrics. The present invention provides convenience in carrying a wallet by differing a length of an outer cover from that of an inner cover, thereby forming a folding region with extra material at the area where the wallet is folded in order to solve the problem of the wallet being excessively thick when it is folded with contents being inserted therein, since an existing foldable wallet is manufactured without considering the folded region when it is folded in trisection to be carried.

6 Claims, 2 Drawing Sheets

FOLDABLE WALLET MADE OF TEXTILE FABRICS

BACKGROUND OF THE INVENTION (a) Field of the Invention

The present invention relates to a foldable wallet made of textile fabrics, and more particularly to a foldable wallet made of textile fabrics in which convenience in carrying the wallet is provided by differing a length of an outer cover from that of an inner cover, thereby forming a folding region of additional material at the area where the wallet is folded.

(b) Description of the Related Art

There have been disadvantages in that a wallet becomes fat on the whole such that it is not easy to put it in and draw it out of a pocket of trousers, and overall dress shape becomes poor, when even a little bit larger than average amount of contents such as bills and credit cards are put into the wallet, since a region of the wallet that is folded in trisection and put into a back pocket of trousers, etc. is not considered.

SUMMARY OF THE INVENTION

The present invention was invented so as to solve the problems of wallets according to the prior art. Therefore, it is an object of the present invention to provide a wallet that is not excessively fat when folded, even when it contains a little bit larger amount of contents than normal, by differing a length of an outer cover from that of an inner cover, i.e., providing additional material to the outer cover in the area where the wallet is folded.

In order to achieve the above object, the present invention provides an ordinary foldable wallet made of textile fabrics having a plurality of carrying compartments, wherein the foldable wallet is characterized in that folding regions are formed by joining an Inner cover having the same number of grooves as there are folding regions where the wallet is folded with an outer cover, a length of which is longer than that of the inner cover.

BRIEF DESCRIPTION OF THE DRAWINGS

The accompanying drawings, which are incorporated in and form a part of the specifications, illustrate the preferred embodiments of the present invention, and together with the description serve to explain the principles of the invention.

In the drawings.

DETAILED DESCRIPTION OF A PREFERRED EMBODIMENT

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

The present invention is described in detail as follows, referring to the attached drawings.

Figure 1:
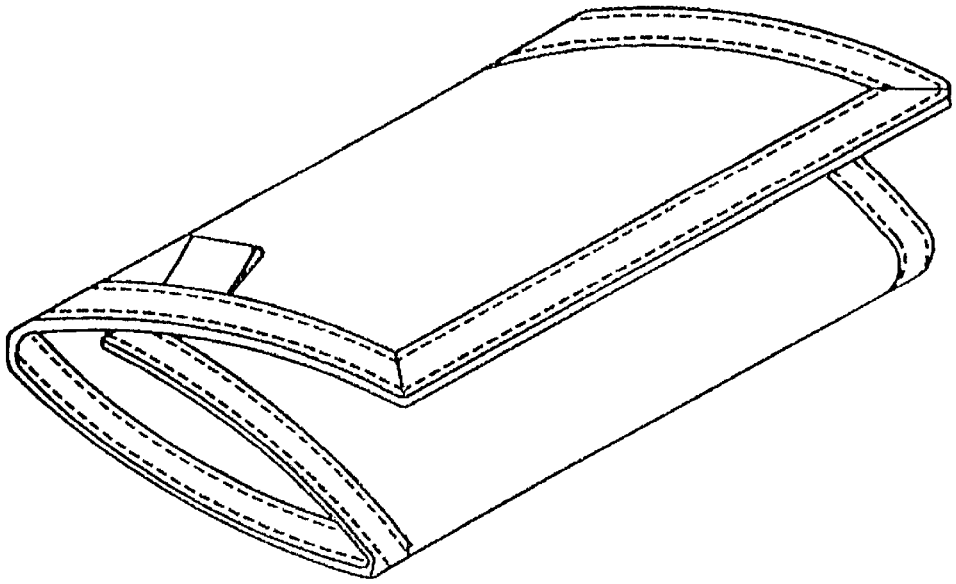
FIG. 1 PRIOR ART
FIG. 1 is an overall perspective view of a foldable wallet according to the prior art.
Figure 2:
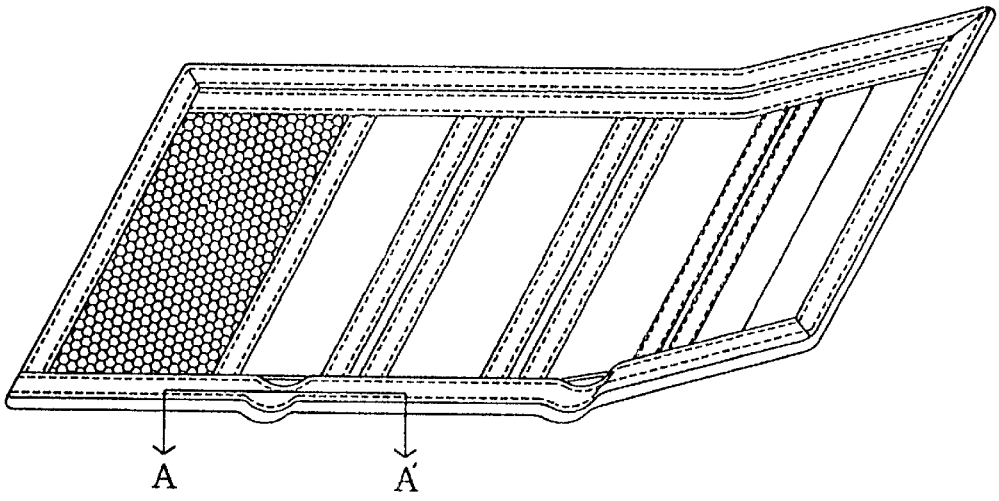
FIG. 2 is a perspective view of a foldable wallet according to the present invention.
Figure 3:
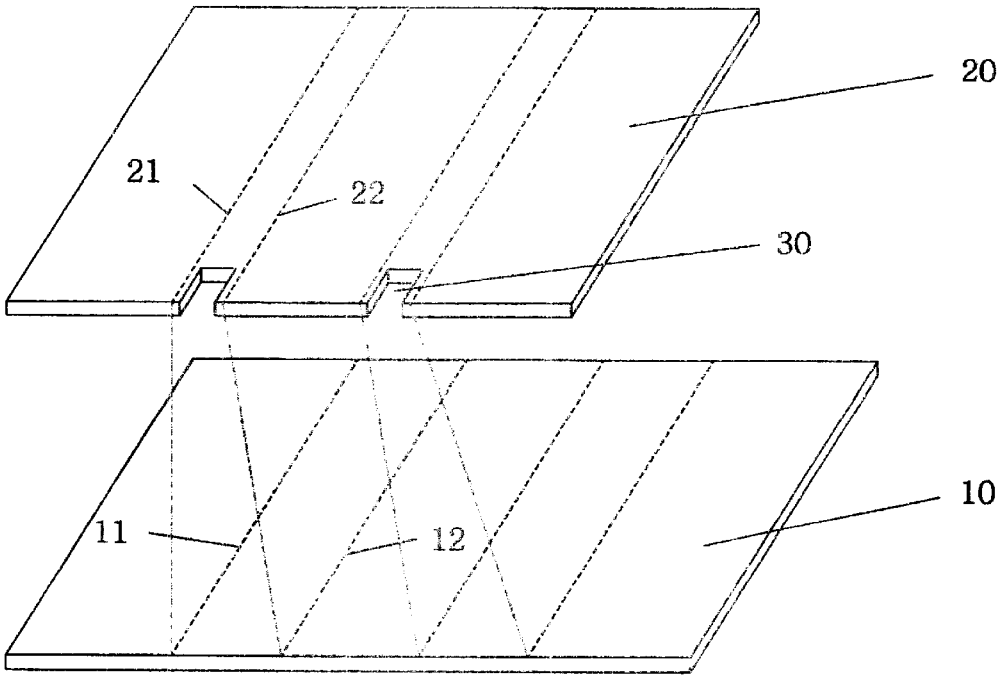
FIG. 3 is a disassembling perspective view of a foldable wallet according to the present invention.
Figure 4:
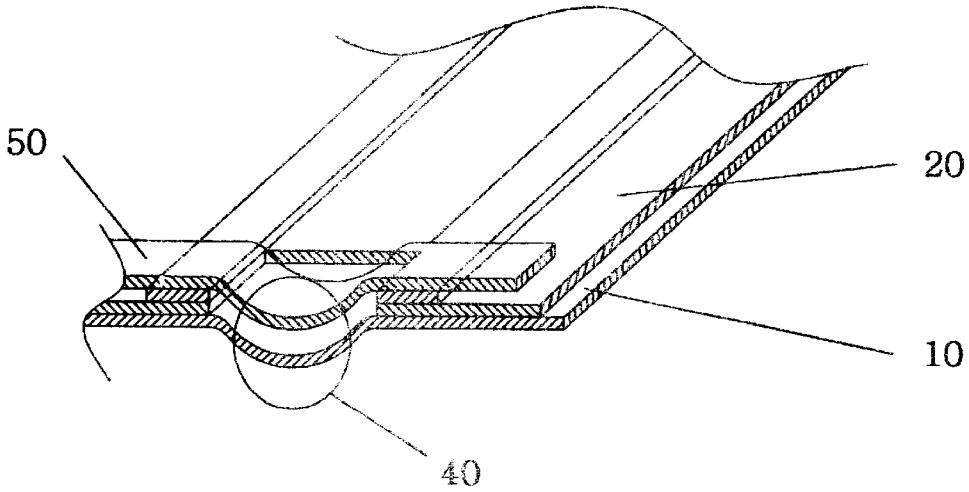
FIG. 4 is a sectional perspective view of a folding region taken along line A–A' in FIG. 2.

FIG. 1 is an entire perspective view of a general foldable wallet made of textile fabrics showing inconvenience in carrying the wallet since it becomes fat even with a small amount of contents being put into it; FIG. 2 is an entire perspective view of a foldable wallet made of textile fabrics according to the present invention, illustrating a folding region formed at the area where the wallet is folded by making a length of an outer cover larger than that of an inner cover; FIG. 3 is a disassembled perspective view of a foldable wallet made of textile fabrics according to the present invention showing a difference between length of an inner cover and that of an outer cover on a plane; and FIG. 4 is a sectional perspective view showing a folding region (40) formed at the area where the wallet is folded, i.e., along line A–A' of FIG. 2.

An ordinary foldable wallet made of textile fabrics has a tendency to be fat when folded even when empty, since it is backstitched without differing a length of an outer cover from that of an inner cover. In the present invention, as shown in FIG. 3, when an outer cover (10) and an inner cover (20) are stitched from an end of a left side to a left corner region of a groove (30) formed on the inner cover, with the outer cover (10) being larger than the inner cover to a degree determined by considering the number and size of folding regions (40) and forming grooves (30) on an inner cover (20) in the areas where the wallet is folded, a pair of an outer cover and an inner cover does not properly fit at the first area where the wallet is folded. That is, a sewing line (12) of an outer cover is not in accord with a sewing line (22) of an inner cover. A folding region (40) with extra material is formed on an outer cover as illustrated in FIG. 4 when a sewing line (12) of an outer cover is pulled to a position of a sewing line (22) of the inner cover (20) and backstitched. Thereafter, forming folding regions at the areas where the wallet is folded and adjusting a pair of an outer cover and an inner cover are progressed in the same method as described in the above.

When backstitching of outer and inner covers is finished in the same method as described in the above, each corner of the wallet is covered with a finishing band (50), and finally backstitched again so that a wallet that is less fat than a foldable wallet made of textile fabrics according to the prior art, even if a relatively larger amount of contents are put into it, is manufactured.

According to the present invention having the above construction, a wallet can be carried more conveniently by making a length of an outer cover larger than that of an inner cover in the area where a foldable wallet made of textile fabrics is folded, thus forming a region with additional material in advance so that the wallet does not get fat even if a little bit larger amount of contents are put into it, as opposed to an ordinary foldable wallet made of textile fabrics.

In this disclosure, there is shown and described only the preferred embodiment of the invention, but, as aforementioned, it is to be understood that the invention is capable of use in various other combinations and environments and is capable of changes or modification within the scope of the inventive concepts as expressed herein.

What is claimed is:

1. A foldable wallet having a plurality of carrying compartments, comprising:

an inner cover having a first length and at least one folding region positioned along said first length;

an outer cover having a second length and at least one folding region positioned along said second length, said second length being greater than said first length;

wherein said inner cover has at least one groove formed at said at least one folding region thereof;

wherein said inner cover is stitched to said outer cover such that said first length is aligned along said second length and said at least one folding region of said inner cover is aligned with said at least one folding region of said outer cover, respectively;

wherein each folding region of said at least one folding region of said inner cover is defined by a pair of sewing lines extending along a width direction of said inner cover; and wherein each folding region of said at least one folding region of said outer cover is defined by a pair of sewing lines extending along a width direction of said outer cover.

2. A foldable wallet as claimed in claim 1, wherein each said folding region of said inner cover corresponds to each said folding region of said outer cover to form a wallet fold region; and for each said wallet fold region, said folding region of said outer cover has its pair of sewing lines spaced apart a distance along said second length greater than a distance by which said inner cover has its pair of sewing lines spaced apart along said first length.

3. A foldable wallet having a plurality of carrying compartments, comprising:

an inner cover having a first length and at least one folding region positioned along said first length;

an outer cover having a second length and at least one folding region positioned along said second length, said second length being greater than said first length;

wherein said inner cover has at least one groove formed at said at least one folding region thereof;

wherein said inner cover is stitched to said outer cover such that said first length is aligned along said second length and said at least one folding region of said inner cover is aligned with said at least one folding region of said outer cover, respectively;

wherein said at least one folding region of said inner cover comprises two folding regions;

wherein said at least one folding region of said outer cover comprises two folding regions;

wherein each of said folding regions of said inner cover is defined by a pair of sewing lines extending along a width direction of said inner cover; and wherein each of said folding regions of said outer cover is defined by a pair of sewing lines extending along a width direction of said outer cover.

4. A foldable wallet as claimed in claim 3, wherein said folding regions of said inner cover correspond to said folding regions of said outer cover to form respective wallet fold regions; and for each said wallet fold region, said folding region of said outer cover has its pair of sewing lines spaced apart a distance along said second length greater than a distance by which said inner cover has its pair of sewing lines spaced apart along said first length.

5. A foldable wallet as claimed in claim 1, wherein said inner cover and said outer cover are made of textile fabric.

6. A foldable wallet as claimed in claim 3, wherein said inner cover and said outer cover are made of textile fabric.

* * * * *